US005088379A

United States Patent [19]

Komiyama

[11] Patent Number: 5,088,379

[45] Date of Patent: Feb. 18, 1992

[54] ELECTRONIC MELODY GENERATING SYSTEM HAVING MEMORY SEPARATED FROM MELODY GENERATING UNIT

[75] Inventor: Manabu Komiyama, Shizuoka, Japan

[73] Assignee: Yamaha Corporation, Shizuoda, Japan

[21] Appl. No.: 493,263

[22] Filed: Mar. 14, 1990

[30] Foreign Application Priority Data

Mar. 24, 1989 [JP] Japan ..... 1-72384

[51] Int. Cl.[5] ..... G10H 1/14; G10H 7/00

[52] U.S. Cl. ..... 84/609; 84/621; 84/624; 84/DIG. 9; 84/DIG. 10

[58] Field of Search ..... 84/609-614, 84/624, 659-661, 696, 735, 736, 621, DIG. 9, DIG. 10

[56] References Cited

U.S. PATENT DOCUMENTS 4,301,704 11/1981 Nagai et al. ..... 84/624 X
4,788,896 12/1988 Uchiyama et al. ..... 84/624
4,922,795 5/1980 Suzuki ..... 84/624 X

FOREIGN PATENT DOCUMENTS 0211144 11/1975 Taiwan .

*Primary Examiner*—Stanley J. Witkowski
*Attorney, Agent, or Firm*—Sughrue, Mion, Zinn Macpeak & Seas

[57] ABSTRACT

A melody generating system is fabricated from a switch unit operative to produce an activation signal, an analog signal producing unit responsive to the activation signal and producing an analog melody signal carrying pieces of melody information used for reproducing a melody and a sound unit responsive to the analog melody signal for reproducing the melody, wherein the analog signal producing unit comprises an analog signal producing circuit integrated on a single semiconductor chip and responsive to the activation signal for producing a read out controlling signal and a memory circuit storing the pieces of melody information and responsive to the read out controlling signal for producing a digital melody information carrying signal, and the analog signal producing circuit is further responsive to the digital melody information carrying signal for producing the analog melody signal, so that a system supplier easily copes with a request for a new melody by changing the pieces of melody information stored in the memory.

5 Claims, 5 Drawing Sheets

ELECTRONIC MELODY GENERATING SYSTEM HAVING MEMORY SEPARATED FROM MELODY GENERATING UNIT

FIELD OF THE INVENTION

This invention relates to an electronic melody generating system or a synthesizer and, more particularly, to a multi-chip melody signal generating unit incorporated therein for supplying an analog melody signal carrying pieces of melody information to a sound unit.

DESCRIPTION OF THE RELATED ART

A typical example of the electronic melody generating system is illustrated in FIG. 1 and largely comprises a melody signal generating unit 1, a switch unit 2, an analog unit 3 and a loud speaker unit 4. In the melody generating unit 1, a memory 1*a* provides a storage facility for pieces of melody information representative of various elements necessary to reproduce a music such as tone color, note, and tempo. The pieces of melody information are sequentially read out from the memory 1*a* under the control of a controller 1*b*, and a series of digital signals carrying the pieces of the melody information are supplied to an FM modulator 1*c* and a carrier generator 1*d*. Pieces of waveform information for various sine waves are memorized in the FM modulator 1*c* for the frequency modulation. The carrier generator 1*d* produces a carrier signal, and the carrier signal is modulated by the FM modulator 1*c* in the presence of the digital signals carrying the pieces of melody information. The frequency modulated digital signal is fed from the carrier generator 1*d* to a digital-to-analog convertor 1*e* so that an analog frequency-modulated wave signal is supplied from the melody signal generating unit 1 to the sound unit 3. All of the component circuits 1*a*, 1*b*, 1*c*, 1*d* and 1*e* are integrated on a single semiconductor chip, and the semiconductor chip is referred to as "melody IC (Integrated Circuit)". The memory 1*a* is of the mask-ROM (read only memory), and the pieces of melody information is fixedly written thereinto during the fabrication process of the melody IC.

Since the analog frequency modulated wave signal carries not only the pieces of melody information but also undesirable noises, the undesirable noises are eliminated by a low pass filter 3*a* and, then, is relayed to an amplifier 3*b*. The analog frequency modulated wave signal thus shaped and amplified is supplied to the loud speaker unit, and the melody represented by the pieces of melody information is reproduced from the loud speaker unit 4.

However, a problem is encountered in the prior art melody generating system in that the system cannot cope with a request for a new melody. Several kinds of the melody IC are presently available in the market, however, a great amount of new melodies are created and provided in the market, and some of the new melodies are requested to be packed in the melody ICs. Since the pieces of melody information are fixedly written into the memory 1*a* during the fabrication process, the system supplier requests the semiconductor manufacturer to develop a new melody IC, and the new melody IC should be mass-produced in view of the development cost. This results in a commercial barrier to the system supplier.

SUMMARY OF THE INVENTION

It is therefore an important object of the present invention to provide a melody generating system which easily copes with a request for a new melody.

To accomplish the object, the present invention proposes to separate a memory from the melody IC.

In accordance with the present invention, there is provided a melody generating system comprising a) a switch unit operative to produce an activation signal, b) an analog signal producing circuit integrated on a single semiconductor chip and responsive to the activation signal for producing a read out controlling signal, the analog signal producing circuit further responsive to a digital melody information carrying signal for producing an analog melody signal carrying pieces of melody information used for reproducing a melody, c) a memory circuit storing the pieces of melody information and responsive to the read out controlling signal for producing the digital melody information carrying signal, and d) a sound unit responsive to the analog melody signal for reproducing the melody.

BRIEF DESCRIPTION OF THE DRAWINGS

The features and advantages of a melody generating system according to the present invention will be more clearly understood from the following description taken in conjunction with the accompanying drawings in which.

DESCRIPTION OF THE PREFERRED EMBODIMENT

Figure 2:
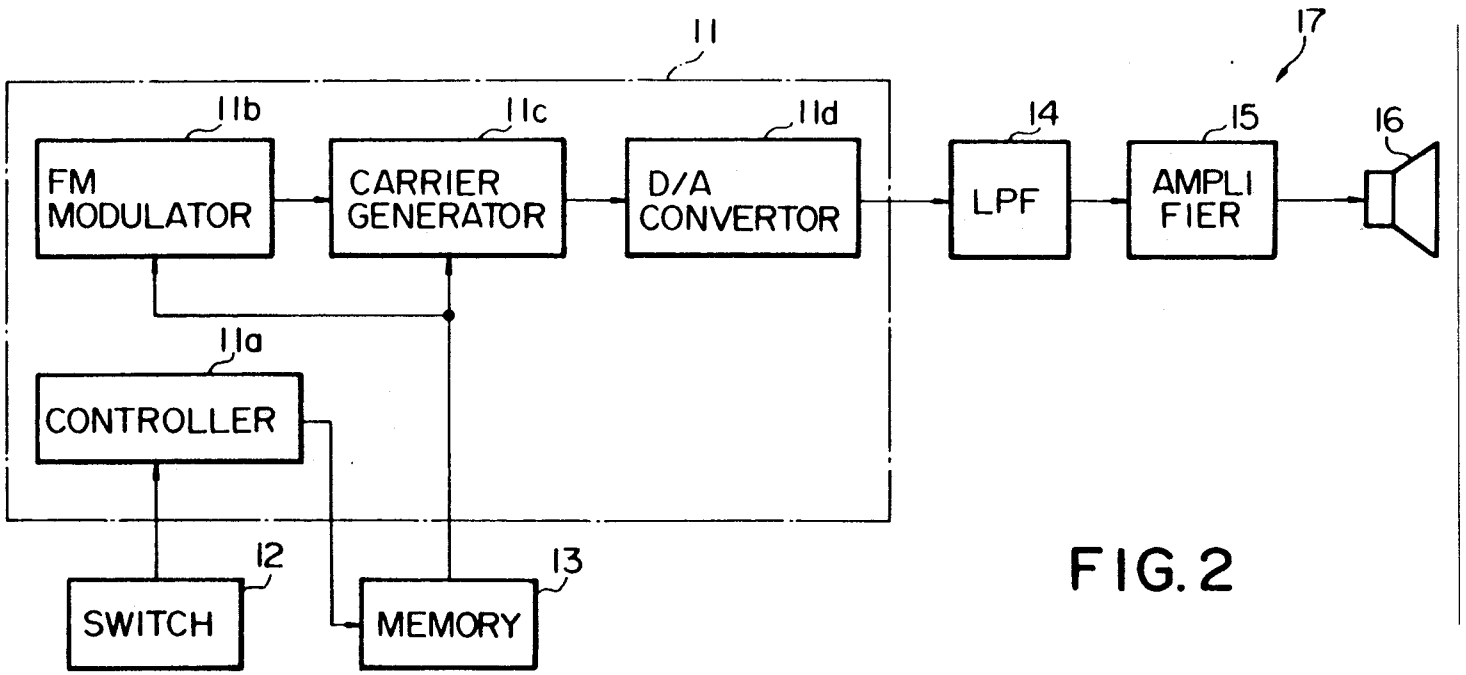
FIG. 2 is a block diagram showing the arrangement of a melody generating system embodying the present invention.

Referring first to FIG. 2 of the drawings, a melody generating system embodying the present invention largely comprises an analog melody signal producing unit 11, a switch unit 12, a memory unit 13, a low pass filter 14, an amplifier 15 and a loud speaker unit 16, and the low pass filter 14, the amplifier 15 and the loud speaker unit 16 as a whole constitute a sound unit 17.

Figure 3:
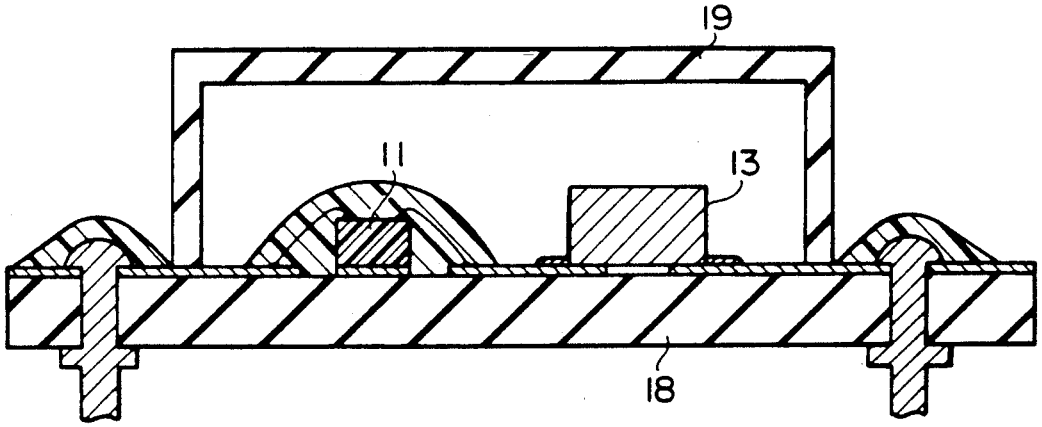
FIG. 3 is a cross sectional view showing the melody generating system mounted on a ceramic board.
Figure 4:
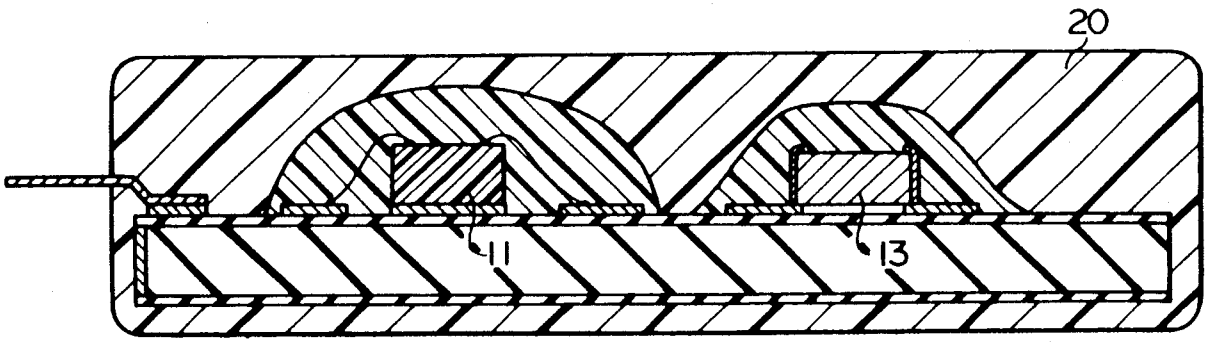
FIG. 4 is a cross sectional view showing the melody generating system sealed in a plastic package.

The analog melody signal producing circuit 11 comprises a controller 11*a*, an FM modulator 11*b*, a carrier generator 11*c* and a digital-to-analog convertor 11*d* which are integrated on a single semiconductor chip. The memory unit 13 is not integrated on the single semiconductor chip, so that the analog melody signal producing circuit 11 and the memory unit 13 are arranged on a small ceramic board 18 together with the low pass filter 14 and the amplifier 15 as shown in FIG. 3. In FIG. 3, reference numeral 19 designates a ceramic cap. The small rigid board 18 may be formed of aluminum nitride and sealed into a plastic package 20, as shown in FIG. 4. However, the small rigid board 18 is replaceable with a flexible film on which a metallization pattern is printed.

The analog melody signal producing circuit 11 has a controller 11*a*, an FM modulator 11*b*, a carrier generator 11*c* and a digital-to-analog converter 11*d*, and the FM modulator 11*b* and carrier generator 11*c* provide quadruplex signal paths or channels, so that four different sounds can be concurrently reproduced in the sound unit 17.

The switch unit 12 is manipulated by a user and produces an activation signal which is fed to a controller 11*a* incorporated in the analog melody signal producing circuit 11. The controller 11*a* is responsive to the activation signal and sequentially produces a series of read out controlling signals indicative of memory addresses. The read out controlling signals are supplied to the memory unit 13 outside of the single semiconductor chip where the controller 11*a* is integrated together with other component circuits.

Figure 5:
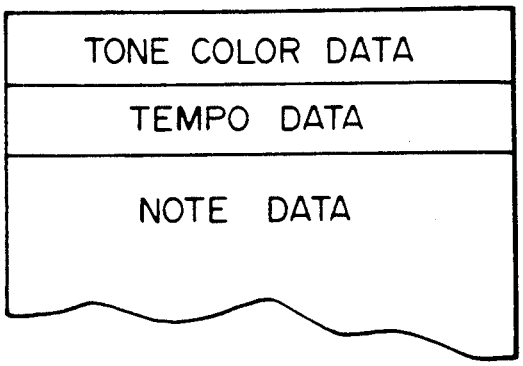
FIG. 5 is a view showing the layout of a storage facility implemented by a memory unit incorporated in the melody generating system shown in FIG. 2.
Figure 6:
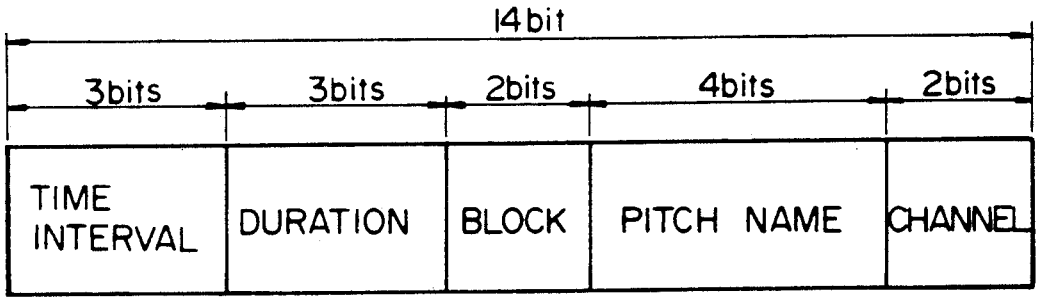
FIG. 6 a view showing the format in which the pieces of melody information is formed.

The memory unit 13 provides a storage facility for pieces of melody information such as, for example, tone color, note and tempo. FIG. 5 shows a layout of the storage facility by way of example. Each the pieces of melody information is provided in the 14-bit digital data format, and the data format for the note data consists of three-bit time interval field, three-bit duration field, two-bit block field, four-bit pitch name field and two-bit channel field as shown in FIG. 6. Since the four channels are provided in the analog melody signal producing circuit 11, one of the channels needs to be designated by the two-bit channel field. The two bit block field is used for designation of an octave, and the pitch name field specifies one of the pitch names in the designated octave. The duration field is indicative of a time duration over which the sound is continuously reproduced, and the time interval field is used for deciding a time interval between two melody data fed from the memory unit 13.

In operation, if the switch unit 12 is depressed by the user, the activation signal is supplied to the controller 11*a*, and the controller 11*a* sequentially produces the read out controlling signals. With the read out controlling signals, the memory unit 13 sequentially reads out the pieces of melody information, and digital signals carrying the respective pieces of melody information are supplied to the FM modulator 11*b* and the carrier generator 11*c*. As described hereinbefore, the FM modulator 11*b* and the carrier generator 11*c* provide four channels, the digital signals are selectively assigned to the four channels. The FM modulator 11*b* memorizes pieces of wave information for various sine waves, and these sine wave data are selectively supplied to the carrier generator 11*c* for producing a digital FM modulated signal carrying the pieces of melody information. If all of the channels are busy, the digital FM modulated signal consists of four sub-digital FM modulated signals. The digital FM modulated signal is converted into an analog FM modulated signal also carrying the pieces of melody information at the digital-to-analog converter 11*d*, and undesirable noises are eliminated from the analog FM modulated signal at the low pass filter 14. The analog FM modulated signal thus shaped is increased in magnitude at the amplifier 15, and the loud speaker unit 16 reproduces a melody consisting of a plurality of sounds.

As will be understood from the foregoing description, the melody generating system according to the present invention is responsible to the request for a new melody by changing the memory unit 13 to another one storing pieces of melody information indicative of the new melody. If the memory unit 13 is implemented by a programmable read only memory such as, for example, an erasable programmable read only memory (EPROM) or an electrically erasable programmable read only memory (EEPROM), a set of new pieces of melody information are quite easily written into the memory unit 13, so that the time period necessary for the development is drastically decreased, and, accordingly, is conducive to reduction in cost.

Figure 1:
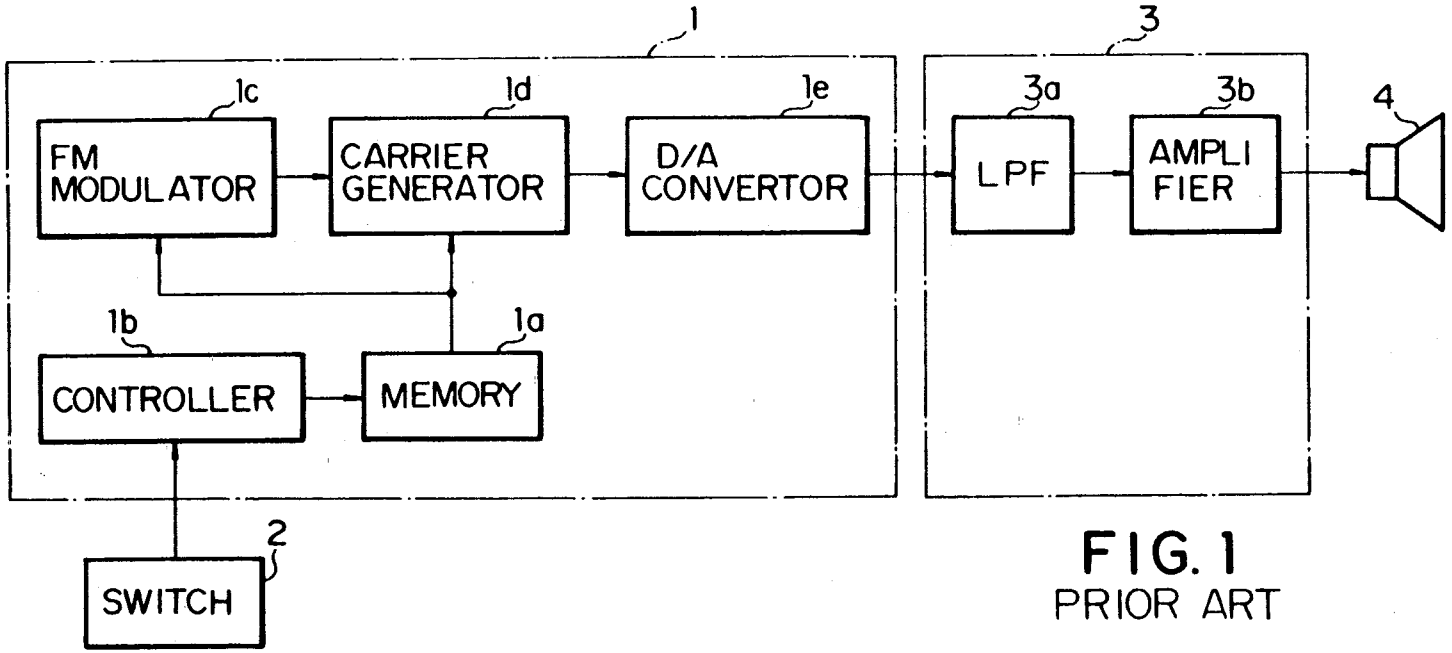
FIG. 1 PRIOR ART
FIG. 1 is a block diagram showing the arrangement of a prior art melody generating system.

The melody generating system equipped with the programmable read only memory is suitable for a tool with which the melody generating system shown in FIG. 1 is developed. Moreover, the melody generating system shown in FIG. 2 may be temporarily used during a transitional period between a well-known melody and a new melody.

Although only one particular embodiment of the present invention has been shown and described, it will be obvious to those skilled in the art that various changes and modifications may be made without departing from the spirit and scope of the present invention.

What is claimed is:

1. A melody generating system comprising a) a switch unit operative to produce an activation signal, b) an analog signal producing circuit integrated on a single semiconductor chip and coupled to said switch unit, said analog signal producing circuit being responsive to said activation signal for producing a read out controlling signal, said analog signal producing circuit being further responsive to a digital melody signal for producing an analog melody signal carrying pieces of melody information used for reproducing a melody, c) a memory circuit storing the pieces of melody information and coupled to said analog signal producing circuit, said memory circuit being formed outside said single semiconductor chip, said memory circuit being responsive to the read out controlling signal for producing the digital melody signal indicative of said pieces of melody information, and d) a sound unit coupled to said analog signal producing circuit and responsive to the analog melody signal for reproducing the melody.

2. A melody generating system as set forth in claim 1, in which said analog signal producing circuit comprises a controller responsive to the activation signal and producing the read out control signal, an FM modulator coupled to said memory circuit and responsive to said digital melody signal indicative of the pieces of melody in formation fed from said memory unit for controlling a carrier generator so as to produce a digital FM modulated signal, and a digital-to-analog converter coupled to said carrier generator and supplied with the digital FM modulated signal for producing the analog melody signal.

3. A melody generating system as set forth in claim 2, in which the combination of said FM modulator and said carrier generator provides a plurality of channels.

4. A melody generating system as set forth in claim 3, in which each of said pieces of melody information contains a piece of channel information for designating one of said plurality of channels used for communication with said digital-to-analog converter.

5. A melody generating system as set forth in claim 4, in which said sound unit comprises a low pass filter coupled to said digital-to-analog converter and operative to eliminate noises from said analog melody signal, an amplifier coupled to said low pass filter and operative to increase the analog melody signal in magnitude, and a loudspeaker unit coupled to said amplifier and operative to reproduce the melody.

* * * * *